US009541864B2

(12) United States Patent
Inaba et al.

(10) Patent No.: US 9,541,864 B2
(45) Date of Patent: Jan. 10, 2017

(54) IMAGE-FORMING APPARATUS

(71) Applicant: CANON KABUSHIKI KAISHA, Tokyo (JP)

(72) Inventors: Yuichiro Inaba, Chigasaki (JP); Masaaki Takeuchi, Mitaka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/202,212

(22) Filed: Mar. 10, 2014

(65) Prior Publication Data

US 2014/0270862 A1 Sep. 18, 2014

(30) Foreign Application Priority Data

Mar. 12, 2013 (JP) ..... 2013-049274

(51) Int. Cl.
*G03G 15/16* (2006.01)

(52) U.S. Cl.
CPC ..... *G03G 15/1605* (2013.01)

(58) Field of Classification Search
USPC ..... 399/310
See application file for complete search history.

(56) References Cited

U.S. PATENT DOCUMENTS 4,703,334 A * 10/1987 Mochimaru et al. ..... 347/130
5,091,751 A * 2/1992 Inoue ..... G03G 15/0131 399/303
5,249,022 A * 9/1993 Watanabe et al. ..... 399/303
5,412,460 A * 5/1995 Okazaki ..... G03G 15/167 399/310
5,805,957 A * 9/1998 Kodama ..... G03G 15/165 399/121
5,918,096 A * 6/1999 Sano ..... G03G 15/163 361/225
7,783,238 B2 * 8/2010 Oki ..... G03G 15/0131 399/121
7,835,678 B2 * 11/2010 Yasumaru ..... G03G 15/1605 399/121
8,571,433 B2 * 10/2013 Hori et al. ..... 399/90
2007/0003333 A1 * 1/2007 Ishii ..... 399/310
2007/0014597 A1 * 1/2007 Ishii ..... 399/310
2010/0278567 A1 * 11/2010 Nakagawa et al. ..... 399/310
2011/0194879 A1 * 8/2011 Nomura et al. ..... 399/310

FOREIGN PATENT DOCUMENTS

JP 2008-310059 A 12/2008
JP 2009-048051 A 3/2009

* cited by examiner

*Primary Examiner* — W B Perkey
*Assistant Examiner* — Linda B Smith
(74) *Attorney, Agent, or Firm* — Fitzpatrick, Cella, Harper & Scinto

(57) ABSTRACT

A transfer device can make more stable contact with a belt, thus yielding preferable transfer performance. In an image-forming apparatus in which the transfer device has a sheet member, the sheet member includes a conductive sheet, and an electrical connection path section (power source connecting section) for supplying voltage to the conductive sheet from the primary transfer power source, and the power source connecting section is arranged outside an image formation enabling region where a toner image can be formed on a photosensitive drum, in a direction perpendicular to the direction of movement of the intermediate transfer belt.

13 Claims, 8 Drawing Sheets

IMAGE-FORMING APPARATUS

BACKGROUND OF THE INVENTION

Field of the Invention

The present invention relates to an image-forming apparatus, such as a copying machine or printer, which is provided with a function for forming an image on a recording material.

Description of the Related Art

Conventionally, for example, in an image-forming apparatus using an electrophotographic system, a toner image is formed as a developer image on a photosensitive member which serves as an image bearing member. A transfer step is then performed in which an electric field of opposite polarity to the normal charging polarity of the toner is applied to a transfer device, and the toner image borne on the photosensitive member is transferred electrostatically onto a recording material conveyed on a conveyance belt or the surface of an intermediate transfer belt.

Therefore, in an image-forming apparatus provided with a movable transfer belt, intermediate transfer belt, or the like, a voltage application device which applies a voltage required in the transfer step is provided in the transfer device. In this example, there is a configuration in which a contact transfer member, such as a transfer roller, connected to a high-voltage power source forming a voltage application device, is arranged as a transfer device, at a position opposing the photosensitive member across from the belt (on the rear surface side of the belt).

However, in an image-forming apparatus which uses a transfer roller, there is a problem in that the shape of the contact region (transfer nip section) between the belt and the transfer roller is difficult to control.

In order to resolve a problem of this kind, Japanese Patent Application Publication No. 2009-48051 discloses a configuration in which the transfer member described above is formed by a sheet member, an elastic member for pressing the sheet member against the image bearing member, and a supporting member which supports the sheet member, wherein the sheet member approaches the transfer nip section at a certain angle of inclination by the supporting member. According to this composition, the transfer member makes stable contact with the belt and the transfer electric field can be stabilized.

In general, the device for applying a transfer voltage to the transfer member applies a voltage by making contact with the transfer member by means of a metal contact member, or the like.

However, there is a concern in that since the metal has a much lower electrical resistance value than that of the material generally used as the transfer member, then there are local variations in the transfer electric field peripheral to the electric contact point, and the image in this portion is disturbed. In particular, in a configuration in which a sheet member approaches a transfer nip section with a certain angle of inclination, as disclosed in Japanese Patent Application Publication No. 2009-48051, then the transfer electric field is liable to be affected in the peripheral area where the sheet member approaches the transfer nip section. Furthermore, metal has a high coefficient of elasticity with respect to the elastic materials and the sheet members which are generally used as transfer members. Consequently, there is a concern in that the coefficient of elasticity of the transfer member varies in the peripheral area where the contact member is connected, the transfer nip section displays local instabilities, and hence the transfer characteristics are impaired.

SUMMARY OF THE INVENTION

The present invention was devised in view of the circumstances described above, an object thereof being to cause a transfer device to make more stable contact a the belt, so as to obtain good transfer performance.

In order to achieve the aforementioned object, the present invention provides an image-forming apparatus, comprising:

an image bearing member which bears a toner image;

a movable belt; and a transfer device arranged to face the image bearing member via the belt, the transfer device being provided with a sheet member, wherein the sheet member has a conductive section and an electrical connection path section for supplying voltage from a power source to the conductive section, and the connection path section is arranged outside an image formation enabling range where a toner image can be formed on the image bearing member, in a direction perpendicular to a direction of movement of the belt.

In order to achieve the aforementioned object, the present invention provides an image-forming apparatus, comprising:

an image bearing member which bears a toner image;

a movable belt; and a transfer device arranged to face the image bearing member via the belt, the transfer device including a conductive brush member, a planar supporting member which supports the brush member, and an electrical connection path section for supplying voltage to the brush member from a power source, wherein the connection path section is arranged outside an image formation enabling range where a toner image can be formed on the image bearing member, in a direction perpendicular to a direction of movement of the belt.

Further features of the present invention will become apparent from the following description of exemplary embodiments (with reference to the attached drawings).

DESCRIPTION OF THE EMBODIMENTS

Embodiments of the invention are described in concrete detail below with reference to the drawings. The dimensions, materials, shapes and relative positions, and the like, of the constituent parts described in these embodiments should be changed appropriately depending on the composition and various conditions of the apparatus to which the invention is applied, and it is not intended to limit the scope of the invention to the description of the embodiments given below.

The present invention relates to an image-forming apparatus, such as a laser beam printer, copying machine or facsimile device, including a step for transferring a toner image formed on an image bearing member using an electrophotographic system or an electrostatic recording system, onto a belt member or onto a recording material borne on the belt member.

First Example

A first example is described below.

Figure 1:
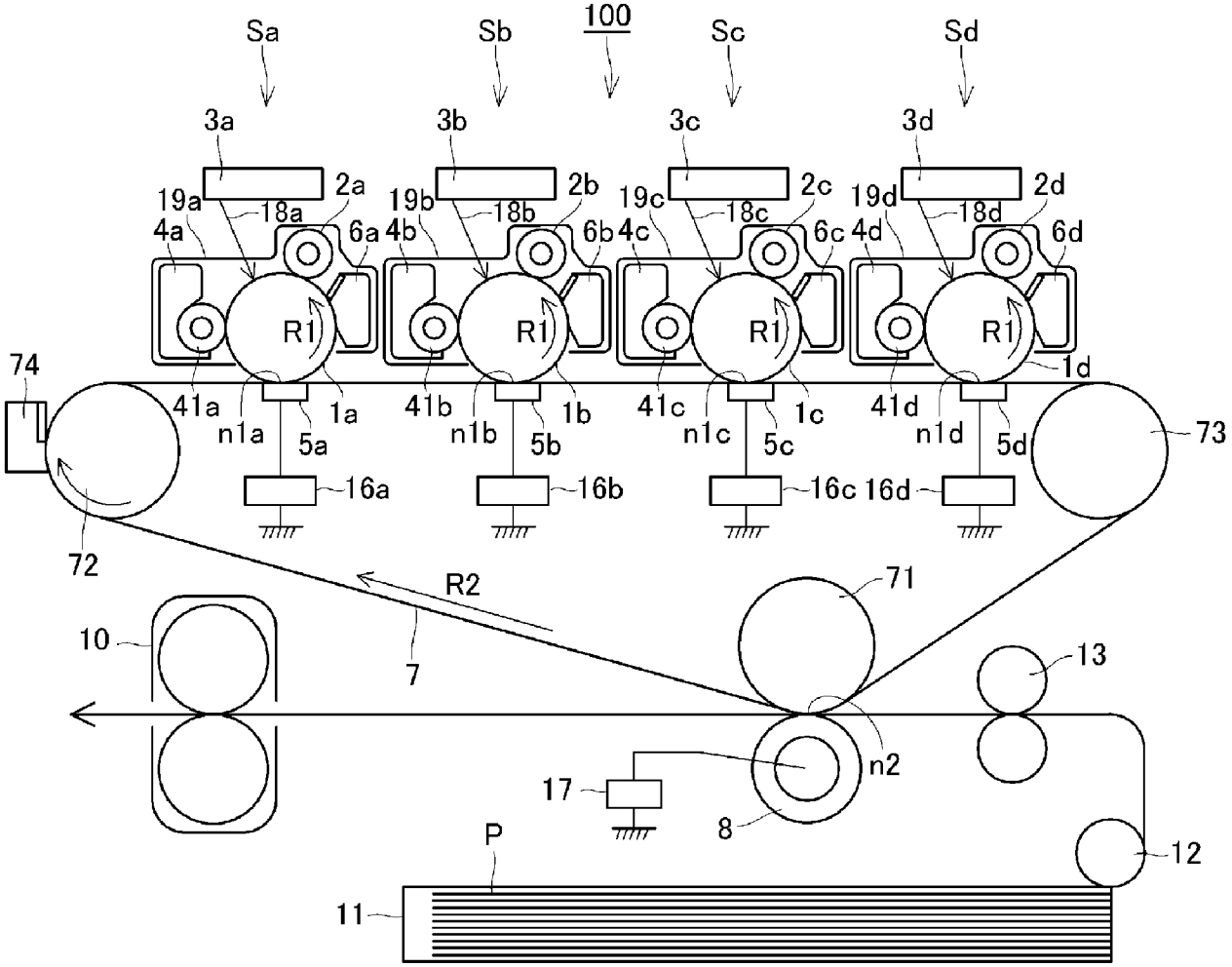
FIG. 1 is a schematic cross-sectional drawing showing a composition of an image-forming apparatus according to a first example of the invention.

FIG. 1 is a cross-sectional schematic drawing showing a composition of an image-forming apparatus 100 according to the present example. In the present example, a color laser printer provided with a plurality of image-forming units is given as an example of an image-forming apparatus using an electrophotographic system. More specifically, the image-forming apparatus 100 according to the present example employs an intermediate transfer method in which toner images of respective colors formed in accordance with image information which has been resolved into respective colour components of yellow, magenta, cyan and black are transferred primarily onto an intermediate transfer member, so as to be superimposed on each other, and are then transferred secondarily onto a recording material.

Firstly, the schematic composition of the image-forming apparatus 100 will be described.

The image-forming apparatus 100 has, as the plurality of image-forming units, four image-forming units (stations) for forming toner images of the respect colors of yellow, magenta, cyan and black, in other words, first, second, third and fourth image-forming units Sa, Sb, Sc, Sd.

In the present example, the composition and operation of the image-forming units Sa to Sd have many substantially common parts, apart from the color of the toner image respectively formed thereby. Consequently, in the description given below, unless a particular distinction is required, the suffixes a, b, c, d which are added to the reference numerals in order to indicate an element provided for one of the colors, are omitted, and a general description is provided.

The image-forming unit S has a drum-type photosensitive member (called "photosensitive drum" below) 1 as an image bearing member. A photosensitive drum 1 is driven to rotate in the direction of the arrow R1 (in the counter-clockwise direction in FIG. 1) by a driver device (not illustrated). In the present example, the photosensitive drum 1 has an organic photoconductor (OPC) photosensitive layer. The image-forming unit S has a charging roller 2 forming a charging device for charging the photosensitive drum 1, and an exposure device 3 and a developing device 4, disposed at the periphery of the photosensitive drum 1. Furthermore, the image-forming unit S has a primary transfer member 5 forming a transfer device, and a cleaning device 6, disposed at the periphery of the photosensitive drum 1.

The cleaning device 6 has a fur brush for wiping away and cleaning toner on the photosensitive drum 1, a cleaning member, such as a blade, and a recovered toner container which recovers toner, and the like, that has been removed from the photosensitive drum 1 by the cleaning member.

In the present example, the developing device 4 develops an electrostatic latent image by a reversal development system. In other words, the developing device 4 forms a toner image on a photosensitive drum 1 by causing toner that has been charged to a normal polarity which is the same as the charging polarity of the photosensitive drum 1 (in the present example, negative polarity) to become attached to portions (bright portions) on the photosensitive drum 1 where the electric charge has decayed due to a photosensitive action (exposure) after being charged.

Moreover, in the present example, the developing device 4 performs a developing operation using a non-magnetic one-component developer, in other words, a toner, as a developer. The developing device 4 is configured in such a manner that toner is deposited onto a developing roller 41, which forms a developer bearing member, by using a developer application blade (not illustrated) as a developer restricting member, whereby the toner is transferred to a section (a developing section) opposite the photosensitive drum 1.

The exposure device 3 may be composed by a laser scanner unit which performs a scanning action of laser light using a multi-surface mirror, or by a LED array, or the like, but in the present example, a laser scanner unit is used. The exposure device 3 irradiates a scanning beam 18 which has been modulated on the basis of an image signal, onto the photosensitive drum 1.

In the present example, the photosensitive drum 1, and the charging roller 2, the developing device 4 and the cleaning device 6, which are processing devices acting on the photosensitive drum 1, are formed as an integrated process cartridge 19 which can be installed in and removed from the main body of the image-forming apparatus (apparatus main body). A process cartridge is a cartridge in which the photosensitive drum, and at least one of the charging device, the developing device and the cleaning device, which are process devices that act on the photosensitive drum, are formed into an integrated cartridge, and which can be installed in and removed from the main body of the image-forming apparatus.

On the other hand, an intermediate transfer belt 7 constituted by a movable endless belt is arranged as an intermediate transfer body, so as to contact all of the four photosensitive drums 1*a* to 1*d*. Toner is transferred from the photosensitive drums 1*a* to 1*d* to the intermediate transfer belt 7 (primary transfer) in the contact regions (primary transfer nip sections; primary transfer sections) n1*a* to n1*d* between the intermediate transfer belt 7 and the respective photosensitive drums 1*a* to 1*d*.

The intermediate transfer belt is supported by three rollers, namely, a secondary transfer opposing roller 71, a driver roller 72 and a tension roller 73, which form stretching members, in such a manner that an appropriate tension is maintained.

By means of the driver roller 72 being driven to rotate, the intermediate transfer belt 7 moves at substantially the same speed in the forward direction with respect to the rotation of the photosensitive drum 1, in the respective primary transfer sections n1*a* to n1*d*. In other words, the intermediate transfer belt 7 rotates in the direction of arrow R2 (the clockwise direction in FIG. 1).

Primary transfer members 5*a* to 5*d* corresponding to the photosensitive drums 1*a* to 1*d* are arranged at positions opposing the photosensitive drums 1*a* to 1*d*, across from (via) the intermediate transfer belt 7. As described in detail below, the primary transfer members 5*a* to 5*d* are arranged so as to be in contact with the surface of the intermediate transfer belt 7 on the opposite side to the surface which bears the toner image. In the description given below, the surface of the intermediate transfer belt 7 which bears the toner image (the surface opposing the photosensitive drum 1, the outer circumferential surface) is called the front surface, and the surface on the opposite side to the front surface (the inner circumferential surface) is called the rear surface.

Furthermore, a secondary transfer roller 8 is arranged as a secondary transfer member, at a position opposing the secondary transfer opposing roller 71, across the intermediate transfer belt 7, so as to contact the intermediate transfer belt 7. The secondary transfer roller 8 contacts the front surface of the intermediate transfer belt 7. A toner image is transferred from the intermediate transfer belt 7 to the recording material P (secondary transfer), in the contact region between the intermediate transfer belt 7 and the secondary transfer roller 8 (secondary transfer nip section; secondary transfer section) n2.

Furthermore, the charging roller 2 is connected to a charging power source (not illustrated), which is a voltage application device for the charging roller 2. The developing roller 41 of the developing device 4 is connected to a developing power source (not illustrated) which is a voltage application device for the developing roller 41. The primary transfer member 5 is connected to the primary transfer power source 16, which is a voltage application device for the primary transfer member 5. The secondary transfer roller 8 is connected to the secondary transfer power source 17, which is a voltage application device for the secondary transfer roller 8.

Next, an image forming operation will be described with reference to full-color image formation as an example.

When an image forming operation is started, the photosensitive drums 1*a* to 1*d*, intermediate transfer belt 7, and so on, respectively start to rotate in a prescribed direction, at a prescribed process speed.

The photosensitive drum 1 is charged uniformly to a prescribed polarity (a negative polarity in the present example), by applying a charging bias voltage to the charging roller 2 from the charging power source (not illustrated). Subsequently, an electrostatic latent image corresponding to the image information is formed by a scanning beam 18 from the exposure device 3, on the charged photosensitive drum 1.

The electrostatic latent image formed on the photosensitive drum 1 reaches a section (a developing section) opposite the developing roller 41 of the developing device 4, due to the rotation of the photosensitive drum 1.

The toner in the developing device 4 is charged to a normal charging polarity (a negative polarity in the present example) by the developer application blade, and is applied to the developing roller 41. Since the developing bias voltage is applied to the developing roller 41 by the developing power source (not illustrated), then the electrostatic latent image on the photosensitive drum 1 is converted to a visible image by the toner of negative polarity, and a toner image is formed on the photosensitive drum 1.

Next, the toner image formed on the photosensitive drum 1 is transferred (primary transfer) onto the intermediate transfer belt 7 in a primary transfer section n1. In this case, a DC bias voltage of opposite polarity to the normal charging polarity of the toner (a positive polarity in the present example) is applied to the primary transfer member 5 by the primary transfer power source 16.

The toner remaining on the photosensitive drum 1 after the primary transfer step (the primary untransferred toner) is removed from the front surface of the photosensitive drum 1 and is recovered, by the cleaning device 6.

By carrying out the respective steps of charging, exposure, developing and primary transfer described above in the first to fourth image-forming units Sa to Sd, toner images of the respective colours are transferred successively in superimposed fashion onto the intermediate transfer belt 7, thereby forming a multilayer image on the intermediate transfer belt 7. In this case, an electrostatic latent image is formed by exposure on the respective photosensitive drums 1*a* to 1*d*, by delaying the writing signal from the controller (not illustrated) by a prescribed timing, for each color, in accordance with the distance between the primary transfer positions of the respective colors.

Subsequently, in synchronism with the formation of an electrostatic latent image by exposure, a recording material P loaded on a recording material cassette 11 is picked up by a recording material supply roller 12, and the recording material is conveyed to a resist roller 13 by a conveyance roller (not illustrated). The recording material P is then conveyed to the secondary transfer section n2 by a resist roller 13, in synchronism with the toner image on the intermediate transfer belt 7.

In this case, a DC bias voltage of opposite polarity to the normal charging polarity of the toner (a positive polarity in the present example) is applied to the secondary transfer roller 8 by the secondary transfer power source 17. Consequently, the four-colour multilayer toner image borne on the intermediate transfer belt 7 is transferred jointly to the recording material P (secondary transfer).

Toner remaining on the intermediate transfer belt 7 after the secondary transfer step (secondary untransferred toner), and paper dust generated by the conveyance of the recording material P, and the like, is removed from the front surface of the intermediate transfer belt 7 and recovered, by a belt cleaning device 74.

In the belt cleaning device 74 according to the present example, adhering material on the intermediate transfer belt 7 is scraped away by a cleaning blade having elasticity made from urethane rubber, or the like, serving as a cleaning member which is arranged in contact with the intermediate transfer belt 7.

The recording material P onto which the toner image has been transferred is conveyed to the fixing apparatus 10, which serves as a fixing device, where the toner image on the recording material P is fused and combined, and fixed onto the recording material P, which is then output to the exterior of the image-forming apparatus 100 as a full-color image forming object (print, copy).

The image-forming apparatus 100 can also form a single or multi-color image by carrying out image formation only in a prescribed one or plurality (but not all) of the image-forming units S. In the present example, a roller formed by an 8 mm-diameter nickel-plated steel bar coated with a conductive foamed sponge member having medium resistance was used as the secondary transfer roller 8. Furthermore, the secondary transfer roller 8 is arranged so as to contact the intermediate transfer belt 7 with a prescribed linear pressure and so as to rotate at substantially even speed in the forward direction with respect to the direction of movement of the intermediate transfer belt 7.

For the material of the intermediate transfer belt 7, it is suitable to use rubber or resin. For the intermediate transfer belt 7 of the present example, a film in the form of an endless belt made from a resin material having medium resistance and a thickness of approximately 60 μm was used.

For the driver roller 72 which is a stretching member for the intermediate transfer belt 7, an aluminium metal bar having a diameter of approximately 25 mm formed by covering an aluminum core with rubber in which carbon is dispersed as a conductive agent was used. For the tension roller 73 which is a stretching member for the intermediate transfer belt 7, a 25 mm-diameter aluminum metal bar was used. A tension was applied to the intermediate transfer belt 7 by impelling both end portions of the tension roller 73 in the direction of the axis of rotation thereof. Moreover, for the secondary transfer opposing roller 71 which is a stretching member for the intermediate transfer belt 7, a roller having a diameter of approximately 25 mm formed by covering an aluminum core with rubber in which carbon is dispersed as a conductive agent was used.

(Primary Transfer Member)

Figure 2:
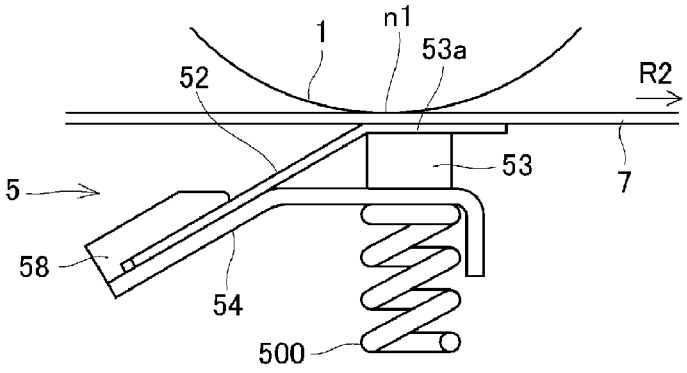
FIG. 2 is a schematic cross-sectional drawing showing a detailed composition of a primary transfer member according to the first example.

Next, the primary transfer members 5 in the image-forming apparatus 100 according to the present example will be described in detail. Here, in the following description, the direction of movement of the intermediate transfer belt 7 is called the belt movement direction. Furthermore, the direction perpendicular to the direction of movement of the belt on the surface of the intermediate transfer belt 7 (perpendicular direction) is called the belt width direction. The belt width direction is the same as the direction of the axis of rotation of the photosensitive drum 1. FIG. 2 is a cross-sectional schematic drawing showing the composition of a primary transfer member 5.

Each of the primary transfer members 5 has a sheet member 52, an elastic member 53, and a sheet supporting member 54, which are described below. The primary transfer members 5*a*, 5*b*, 5*c*, 5*d* each have substantially the same composition.

The elastic member 53 which is substantially a cuboid body forming the elastic member is pressed against the rear surface of the intermediate transfer belt 7 via the sheet member 52 by a compression spring 500. In other words, the elastic member 53 presses the sheet member 52 towards the intermediate transfer belt 7 at a position opposing the photosensitive drum 1. One surface of the elastic member 53 contacts the rear surface of the sheet member 52, as a contact surface 53*a*. Here, in the sheet member 52, the surface opposing the intermediate transfer belt 7 is called the front surface and the surface on the side opposite to the front surface is called the rear surface.

The coefficient of friction between the front surface of the sheet member 52 and the intermediate transfer belt 7 is set so as to be smaller than the coefficient of friction between the elastic member 53 and the intermediate transfer belt 7. By this means, it is possible to lower the frictional resistance between the sheet member 52 and the intermediate transfer belt 7, while causing the elastic member 53 to make stable contact with the sheet member 52.

Furthermore, the sheet member 52 is a sheet material having conductive properties, and a primary transfer electric field is formed due to a primary transfer bias voltage (transfer voltage) from the primary transfer power source 16 being supplied to the intermediate transfer belt 7 from the sheet member 52 via a power supply member. In other words, the sheet member 52 functions as a primary transfer member.

The sheet member 52 and the elastic member 53 are supported by the sheet supporting member 54 due to being bonded to the sheet supporting member 54.

In the present example, the upstream-side end portion of the sheet member 52 in the belt movement direction is bonded to and supported by the sheet supporting member 54 by an adhesive body (not illustrated), such as double-sided tape, and furthermore, is fixed to the main body of the image-forming apparatus (frame) by being held by a sheet pressing member 58 which presses and supports the sheet member 52.

The elastic member 53 is bonded to and supported on any surface of the sheet supporting member 54, which forms a desired angle with respect to the surface on which the sheet member 52 is held, by an adhesive body (not illustrated), such as double-sided tape. Here, the sheet supporting member 54 is provided on the upstream side of the elastic member 53 in terms of the belt movement direction.

The sheet supporting member 54 supports the sheet member 52 and the elastic member 53 at an angle whereby the sheet member 52 approaches at the desired angle of inclination between the intermediate transfer belt 7 and the elastic member 53. In the present example, the region of the sheet member 52 between the upstream-side end portion in the belt movement direction and the downstream-side end portion in the belt movement direction is inclined with respect to the intermediate transfer belt 7 so as to become further distanced from the intermediate transfer belt 7 towards the upstream side in the belt movement direction.

Here, the sheet supporting member 54 is formed by a member having high rigidity, such as sheet metal. The sheet pressing member 58 is coupled to the sheet supporting member 54 by screws, or the like, and presses and holds the sheet member 52 against the sheet supporting member 54.

In this way, the sheet member 52 has sufficient strength with respect to the sliding load of the sheet member 52 and the intermediate transfer belt 7, and is composed so as to be able to ensure a satisfactory position.

Next, the sheet member 52 and the primary transfer section n1 will be described in detail.

Figure 3:
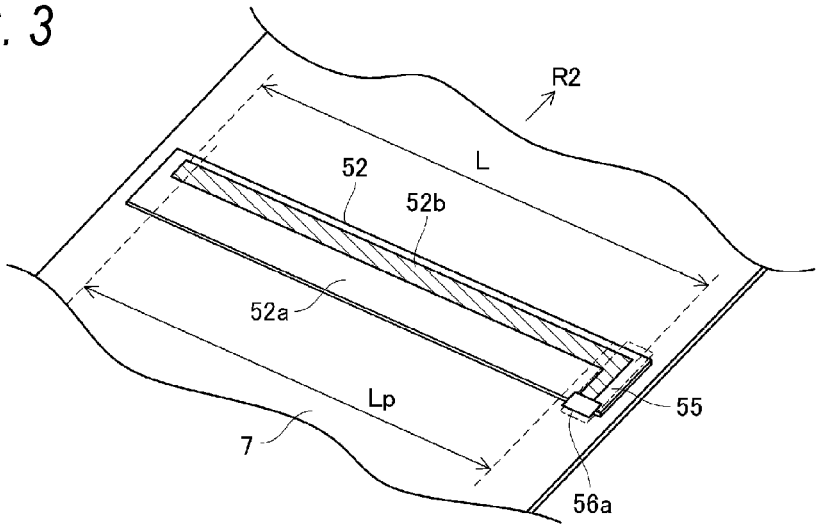
FIG. 3 is a schematic perspective drawing showing a composition of a sheet member according to the first example.
Figure 4:
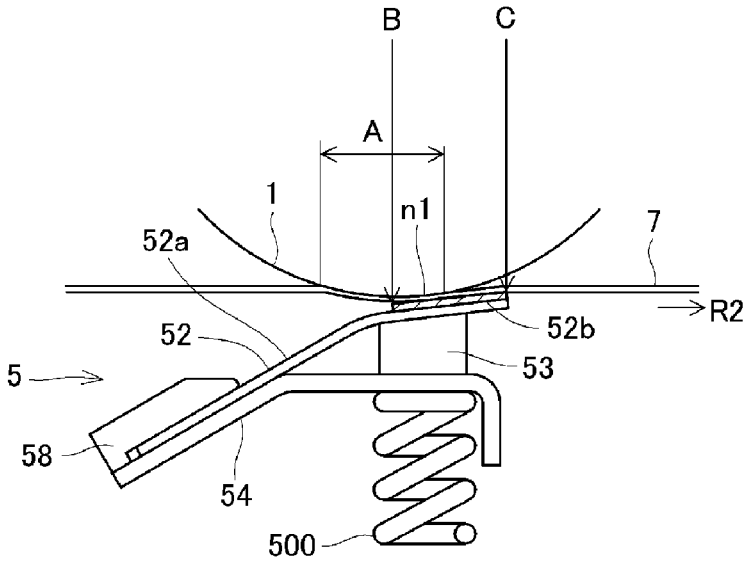
FIG. 4 is a schematic cross-sectional drawing showing a composition of a primary transfer member according to the first example.

FIG. 3 is a schematic perspective drawing showing the composition of the sheet member 52, and FIG. 4 is a cross-sectional schematic drawing showing the composition of the primary transfer section n1. The primary transfer sections n1*a*, n1*b*, n1*c*, n1*d* each have substantially the same composition.

The sheet member 52 is a sheet-shaped member in which a conductive sheet member is fixed onto a non-conductive sheet member, and is composed as follows in the present example.

More specifically, the sheet member 52 is composed in such a manner that a conductive sheet 52*b* having conductive properties to which a transfer voltage is applied is bonded partially to the side of the photosensitive drum 1 (front surface side) of the insulating sheet 52*a*, which is an insulating resin member, by an adhesive material, such as a double-sided tape (not illustrated). Here, the insulating sheet 52*a* is a non-conductive sheet member.

In the present example, the conductive sheet 52*b* is disposed on the downstream-side end portion of the sheet member 52 in the belt movement direction, and is pressed towards the intermediate transfer belt 7 by the elastic member 53 via the insulating sheet 52*a*. Furthermore, the conductive sheet 52*b* is arranged at a position corresponding to the region where the photosensitive drum 1 and the intermediate transfer belt 7 make contact (contact region) in the belt movement direction.

In the present example, a resin material having a thickness of approximately 100 μm is used as the insulating sheet 52*a*, and a resin material having a thickness of approximately 200 μm and having conductive properties is used as the conductive sheet 52*b*.

FIG. 4 is a diagram illustrating a desirable positional relationship between the conductive sheet 52*b* and the contact region between the intermediate transfer belt 7 and the photosensitive drum 1, in the belt movement direction.

The contact region between the photosensitive drum 1 and the intermediate transfer belt 7 is indicated as the physical nip A in FIG. 4.

The sheet member 52 is arranged as described above in such a manner that the portion of the conductive sheet 52*b* contacts the rear surface of the intermediate transfer belt 7, and the elastic member 53 is composed so as to press the conductive sheet 52*b* against the intermediate transfer belt 7.

In FIG. 4, the upstream end portion of the contact region between the conductive sheet 52*b* and the intermediate transfer belt 7 (called the "contact start end" below) is indicated as B, and the downstream end portion of the contact region (called the "contact finish end" below) is indicated as C.

Here, it is desirable for the contact start end B to be positioned inside the range of the physical nip A, in the belt movement direction. Furthermore, it is desirable for the contact finish end C to be positioned outside the range of the physical nip A in the belt movement direction (to the downstream side of the physical nip A in the belt movement direction).

By positioning the contact start end B inside the range of the physical nip A, it is possible to suppress the effects of the transfer field created between the photosensitive drum 1 and the primary transfer member 5, before the physical nip A (to the upstream side thereof in the belt movement direction). In other words, it is possible to suppress image defects (so-called spots around line images) in which the toner image on the intermediate transfer belt 7 is blurred due to the toner image on the photosensitive drum 1 being transferred to the intermediate transfer belt 7 by the transfer field before reaching the physical nip A. Moreover, since the contact finish end C is positioned as described above, the primary transfer member 5 serves as an opposing electrode at the contact finish end where the intermediate transfer belt 7 is separated from the photosensitive drum 1. Consequently, it is possible to suppress the separation discharge, and image defects caused by separation discharge can be prevented without providing a charge removing member for removing charge from the intermediate transfer belt 7.

Furthermore, in the belt width direction, the width L of the conductive sheet 52*b* is greater than the image printing region Lp in which the image-forming apparatus 100 is capable of printing (image formation) on the photosensitive drum 1 (intermediate transfer belt 7). Here, the image printing region Lp corresponds to the image formation enabling range in which a toner image can be formed on the photosensitive drum 1 (on the image bearing member), in the belt width direction.

In other words, as shown in FIG. 3, both ends of the conductive sheet 52*b* are respectively positioned to the outside of the image printing region Lp in the belt width direction.

Furthermore, in the belt width direction, the width of the insulating sheet 52*a* is shorter than that of the intermediate transfer belt 7. More specifically, in the belt width direction, both ends of the insulating sheet 52*a* are respectively positioned inside both ends of the intermediate transfer belt 7, and the conductive sheet 52*b* is also positioned to the inside of both ends of the intermediate transfer belt 7.

As shown in FIG. 3, the conductive sheet 52*b* and the primary transfer power source 16 (see FIG. 1) are electrically connected via a power source connecting section 55 and a metal contact plate 56*a*. The power source connecting section 55 is disposed on the sheet member 52 and therefore corresponds to an electrical connection path section for supplying voltage from the primary transfer power source 16 to the conductive sheet 52*b*.

In the present example, the power source connecting section 55 is composed by forming a region of the conductive sheet 52*b* which is positioned outside the image printing region Lp in the belt width direction so as to extend to the upstream side in the belt movement direction. More specifically, the conductive sheet 52*b* and the power source connecting section 55 are made from conductive sheet members, and in the present example, in particular, are formed in an integrated fashion as one conductive sheet member.

In this way, in the present example, the power source connecting section 55 is arranged in a region outside the image printing region Lp in the belt width direction, in the same plane as the sheet member 52.

Here, in FIG. 3, a case is shown where one power source connecting section 55 is provided, but the invention is not limited to this, and it is also possible to provide power connecting sections respectively in both end regions to the outside of the image printing region Lp in the belt width direction. Furthermore, there are no particular restrictions on this arrangement, and it is also possible to provide power source connecting sections 55 in a plurality of locations.

Figure 5:
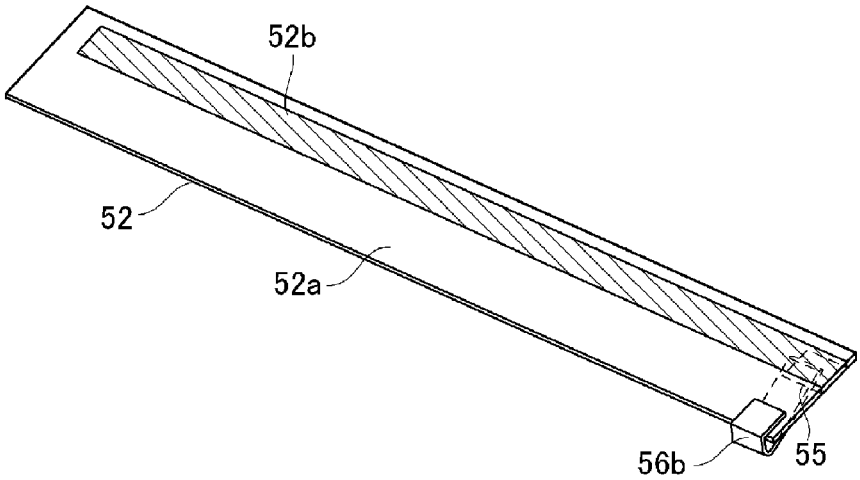
FIG. 5 is a schematic perspective drawing showing another embodiment of a sheet member.

FIG. 5 is a schematic perspective drawing showing a further mode of the sheet member 52.

As shown in FIG. 5, the power source connecting section 55 may be formed by bending the conductive sheet 52*b* such that the conductive sheet 52*b* covers the rear surface of the insulating sheet 52*a*, whereby electrically connection with a metal contact plate 56*b*, or the like, is established on the rear surface side of the insulating sheet 52*a*.

The description now discusses concerns which arise when the power source connecting section 55 is situated to the inside of the image printing region Lp in the belt width direction, in the sheet member 52.

Figure 6:
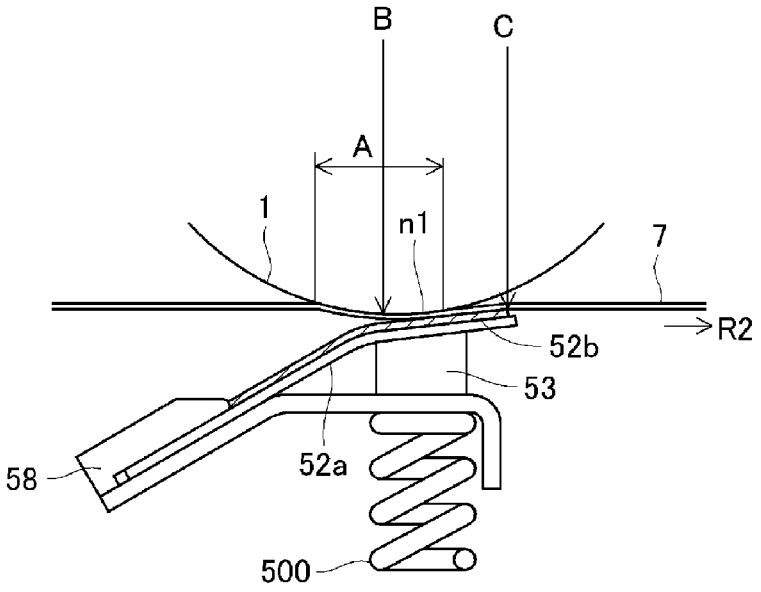
FIG. 6 is a schematic cross-sectional drawing showing another embodiment of a primary transfer section.

For example, FIG. 6 shows a primary transfer section n1 in a case where the power source connecting section 55 is inside the image printing region Lp in a composition in which an electrical connection with the primary transfer power source 16 is obtained by extending a portion of the conductive sheet 52*b* in the belt movement direction, as in the power source connecting section 55 shown in FIG. 3.

In this case, as shown in FIG. 6, the conductive sheet 52*b* is interposed to the upstream side of the contact start end B of the conductive sheet 52*b* and the intermediate transfer belt 7, in terms of the belt movement direction.

Here, the transfer field intensity on the upstream side of the contact start end B in terms of the belt movement direction decays in proportion to the spatial distance between the intermediate transfer belt 7 and the conductive sheet 52*b*.

Therefore, in FIG. 6, the transfer field intensity on the further upstream side in the belt movement direction than the contact start end B decays proportionately as the spatial distance between the intermediate transfer belt 7 and the conductive sheet 52*b* increases gradually.

On the other hand, in the composition of the primary transfer section shown in FIG. 4 according to the present example, the conductive sheet 52*b* is not interposed to the upstream side of the contact start end B in terms of the belt movement direction, and therefore the transfer field intensity decays suddenly.

In this way, a differential is created in the transfer field intensity on the upstream side of the contact start end B in terms of the belt movement direction, depending on the presence or absence of the power source connecting section 55. In other words, if the power source connecting section 55 of the sheet member 52 is positioned inside the image printing region Lp in the belt width direction, then there is a concern that transfer properties will be affected only in the periphery of the power source connecting section 55, leading to a decline in image quality.

The description now discusses concerns which arise in a case where a metal contact plate 56*b* such as that shown in FIG. 5 is formed as a power source connecting section 55 inside the image printing region Lp in the belt width direction, in the sheet member 52.

In general, a resin material which is the material of the sheet member 52 constituting the primary transfer member 5 has a low coefficient of elasticity compared to a metal material which is used in the metal contact plate 56*b*. This means that the pressing force applied to the photosensitive drum 1 by the sheet member 52 is affected by the metal contact plate 56*b*, and there is a risk of problems occurring in the uniformity of the transfer pressure. If non-uniformities occur in the transfer pressure, then there is a concern about decline in the image quality.

As described above, in the present example, the power source connecting section 55 is arranged in a region of the sheet member 52 to the outside of the image printing region Lp in the belt width direction. By this means, it is possible to provide an image-forming apparatus which achieves more satisfactory and more stable transfer performance, and yields high-quality images in a more stable fashion, by means of a simple composition. Furthermore, in the sheet member 52, by providing a power source connecting section 55 of minimum width in the region to the outside of the image printing region Lp in the belt width direction, it is possible to minimize the increase in the size of the main body of the image-forming apparatus.

Second Example

Below, a second example will be described. In the present example, constituent portions which are different from those in the first example are described, and constituent portions which are the same as the first example are omitted from the description.

Figure 7:
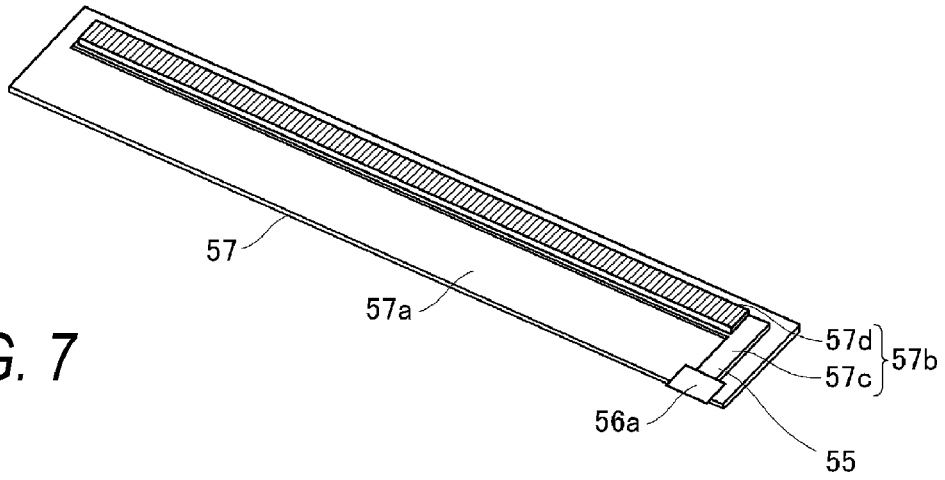
FIG. 7 is a schematic perspective drawing showing a composition of a sheet member according to a second example of the invention.
Figure 8:
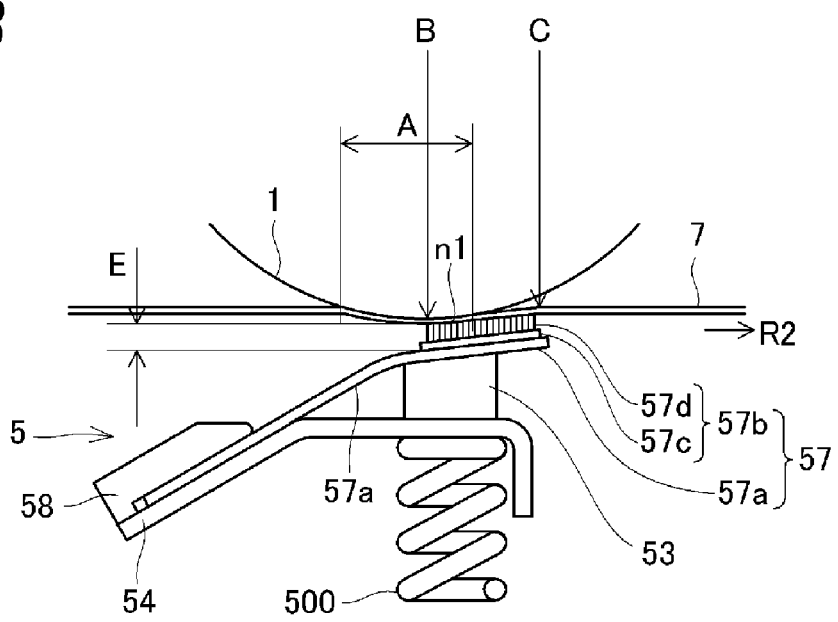
FIG. 8 is a schematic cross-sectional drawing showing a composition of a primary transfer member according to the second example.

FIG. 7 is a schematic perspective drawing showing the composition of a sheet member 57 according to the present example, and FIG. 8 is a cross-sectional schematic drawing showing the composition of a primary transfer member 5 according to the present example.

Firstly, the primary transfer member 5 according to the present example will be described with reference to FIG. 7.

The sheet member 57 according to the present example is a sheet-shaped member in which a conductive brush 57*b* forming a conductive brush member is bonded partially by an adhesive material, such as double-sided tape (not illustrated), to a downstream-side end section, in the belt movement direction, of an insulating sheet 57*a*, which is an insulating resin member. Here, the insulating sheet 57*a* (non-conductive sheet member) corresponds to a pressing member which supports the conductive brush 57*b* and presses the conductive brush 57*b* against the intermediate transfer belt 7.

The conductive brush 57*b* is formed by weaving and fixing fibers having conductive properties (conductive threads) into a base cloth having conductive properties, in such a manner that the fiber portion (called the brush tip section 57*d* below) contacts the intermediate transfer belt 7.

In the present example, a resin material having a thickness of approximately 100 μm is used for the insulating sheet 57*a*. Furthermore, a brush-shaped member including a base cloth 57*c* having low resistance conductivity, and a brush tip section 57*d* formed by weaving conductive threads made of conductive nylon having a pile length of 1.7 mm into the base cloth 57*c*, is used as the conductive brush 57*b*.

Here, the brush tip section 57*d* in the sheet member 57 is formed so as to have a greater width than the image printing region Lp in the belt width direction.

As shown in FIG. 7, the conductive brush 57*b* and the primary transfer power source 16 are electrically connected via a power source connecting section 55 and a metal contact plate 56*a*. Since the power source connecting section 55 is electrically connected to the base cloth 57*c* and the metal contact plate 56*a*, the conductive brush 57*b* and the primary transfer power source 16 are electrically connected.

In the present example, the base cloth 57*c* is composed so as to serve also as a power source connecting section 55, by forming a region of the base cloth 57*c* which is positioned outside the image printing region Lp in the belt width direction so as to extend to the upstream side in the belt movement direction.

In this way, in the present example also, the power source connecting section 55 is arranged in a region of the sheet member 57 to the outside of the image printing region Lp in the belt width direction. In the present example, the power source connecting section 55 is bonded to the top of the insulating sheet 57*a* (the top of the pressing member) to the outside of the image printing region Lp, in the belt width direction.

The beneficial effects of arranging the power source connecting section 55 in a region to the outside of the image printing region Lp in the belt width direction, and further modes, are as described in the first example.

Next, the primary transfer member n1 according to the present example will be described with reference to FIG. 8.

Since the photosensitive drum 1 and the intermediate transfer belt 7 are arranged so as to make contact with each other, then there is a physical contact region (physical nip A) between the photosensitive drum 1 and the intermediate transfer belt 7.

The conductive brush 57*b* contacts the rear surface of the intermediate transfer belt 7 via the brush tip section 57*d*, and in FIG. 8, the contact start end between the conductive brush 57*b* and the intermediate transfer belt 7 is indicated by B and the contact finish end is indicated by C.

In the present example, similarly to the first example, it is desirable for the contact start end B to be positioned in the range of the physical nip A, and for the contact finish end C to be positioned outside the range of the physical nip A and to the downstream side of the physical nip A in terms of the belt movement direction.

Moreover, in the present example, similarly to the first example, a sheet supporting member 54 supports the sheet member 57 and the elastic member 53 at an angle whereby the sheet member 57 approaches at the desired angle of inclination between the intermediate transfer belt 7 and the elastic member 53.

Moreover, in the present example, by using a conductive brush 57*b*, a larger distance E between the intermediate transfer belt 7 and the insulating sheet 57*a* can be ensured compared to the conductive sheet 52*b* described in the first example.

In the first example, since the position of the contact start end B is situated towards the downstream side in the belt movement direction, then the insulating sheet 52*a* and the intermediate transfer belt 7 are constantly rubbing. In general, the resin material used in the insulating sheets 52*a*, 57*a* has a high coefficient of friction with respect to the intermediate transfer belt 7, compared to the conductive resin material used in the first example or the conductive nylon brush tip section used in the present example. Therefore, under the conditions described above, the rubbing resistance between the insulating sheets 52*a*, 57*a* and the intermediate transfer belt 7 is high.

Consequently, by ensuring a large distance E, a beneficial effect is achieved in that rubbing between the insulating sheet 57*a* and the intermediate transfer belt 7, which have a high coefficient of friction, is prevented, and destabilization of the transfer nip section and damage to the primary transfer member can be avoided.

Furthermore, in the present example, the coefficient of elasticity of the base cloth 57*c* is configured so as to be lower than the coefficient of elasticity of the insulating sheet 57*a*.

Accordingly, it is possible to suppress the effects of the base cloth 57*c* on the pressing force applied to the photosensitive drum 1 by the sheet member 57, and therefore more uniformed transfer pressure can be obtained, and decline in image quality can be suppressed.

The image-forming apparatus relating to the present invention is not limited to the first and second examples described above, and various modifications may be added within a scope that does not depart from the essence of the present invention. More specifically, a composition should be adopted in which the power source connecting section 55 is arranged to the outside of the image printing region Lp in the belt width direction. In the first and second examples described above, an image-forming apparatus 100 based on an intermediate transfer system was described, but the invention is not limited to this. In other words, the present invention can also be applied satisfactorily to an image-forming apparatus based on, as a belt, a direct transfer system which is provided with a conveyance belt for supporting and conveying a recording material, instead of the intermediate transfer belt 7. In an image-forming apparatus based on a direct transfer system, a color image is formed by directly transferring toner images formed respectively on the surfaces of photosensitive drums, successively onto a recording medium conveyed (supported and conveyed) to respective image-forming units by a conveyance belt. Since an image-forming apparatus of this kind is well-known, further description thereof is omitted here. Furthermore, the present invention can also be applied desirably to a monocolour image-forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-049274, filed Mar. 12, 2013 which is hereby incorporated by reference herein in its entirety.

What is claimed is:

1. An image-forming apparatus, comprising:

an image bearing member which bears a toner image;

a movable belt; and a transfer device arranged to face the image bearing member via the belt, the transfer device being provided with a non-conductive sheet member, a conductive sheet member fixed onto the non-conductive sheet member, and an elastic member which presses the non-conductive sheet member towards the belt, wherein the conductive sheet member has a conductive section and an electrical connection path section for supplying voltage from a power source to the conductive section, the connection path section is arranged outside an image formation enabling range, where a toner image can be formed on the image bearing member, in a belt width direction perpendicular to a direction of movement of the belt and parallel to an axis of rotation of the image bearing member, and in a pressing direction of the elastic member, the elastic member, the non-conductive sheet member, and the conductive section are arranged in a line.

2. The image-forming apparatus according to claim 1, wherein, in the direction of movement of the belt, the conductive section is arranged in a position corresponding to a region of contact at which the image bearing member and the belt are in contact with each other.

3. The image-forming apparatus according to claim 1, wherein the conductive section is disposed in a downstream-side end portion of the non-conductive sheet member in terms of the direction of movement of the belt, an upstream-side end portion of the non-conductive sheet member in terms of the direction of movement of the belt is fixed, and a region between the upstream-side end portion and the downstream-side end portion of the non-conductive sheet member is inclined with respect to the belt so as to be further distanced gradually from the belt towards the upstream side.

4. The image-forming apparatus according to claim 1, wherein the conductive sheet member is fixed onto the non-conductive sheet member at a side of the image bearing member.

5. The image-forming apparatus according to claim 1, wherein a width of the conductive sheet member is greater than the image formation enabling range in the belt width direction.

6. The image-forming apparatus according to claim 2, wherein the conductive section is arranged in such a manner that an upstream end section thereof, with respect to the direction of movement of the belt, is positioned inside the region of contact at which the image bearing member and the belt are in contact with each other, and a downstream end portion thereof is arranged downstream the region of contact.

7. An image-forming apparatus, comprising:

an image bearing member which bears a toner image;

a movable belt; and a transfer device arranged to face the image bearing member via the belt, the transfer device including a conductive brush member, a planar supporting member which supports the brush member, an electrical connection path section for supplying a transfer voltage for image formation to the brush member from a power source, and an elastic member which presses the supporting member towards the belt, wherein the connection path section is arranged outside an image formation enabling range where a toner image can be formed on the image bearing member, in a belt width direction perpendicular to a direction of movement of the belt and parallel to an axis of rotation of the image bearing member, and in a pressing direction of the elastic member, the elastic member, the supporting member, and the brush member are arranged in a line.

8. The image-forming apparatus according to claim 7, wherein the connection path section is bonded to the supporting member outside the image formation enabling range in the belt width direction.

9. The image-forming apparatus according to claim 7, wherein, in terms of the direction of movement of the belt, the brush member is arranged in such a manner that an upstream-side end portion of a region in which the fibers and the belt are in contact with each other is positioned inside a region in which the image bearing member and the belt are in contact with each other, and a downstream-side end portion of the region in which the fibers and the belt are in contact with each other is positioned downstream of the region in which the image bearing member and the belt are in contact with each other.

10. The image-forming apparatus according to claim 7, wherein the brush member includes fibers having conductivity, and a base cloth having conductivity and which fixes the fibers, the fibers are disposed so as to contact the belt, and the connection path section is electrically connected to the base cloth.

11. The image-forming apparatus according to claim 10, wherein the base cloth is formed so as to extend to the outside of the image formation enabling range in the belt width direction, and also serves as the connection path section.

12. The image-forming apparatus according to claim 11, wherein the supporting member is a non-conductive sheet member, an upstream-side end portion of the non-conductive sheet member in terms of the direction of movement of the belt is fixed, and a region between the upstream-side end portion and a downstream-side end portion of the non-conductive sheet member is inclined with respect to the belt so as to become further distanced gradually from the belt towards the upstream side.

13. The image-forming apparatus according to claim 12, wherein the brush member is disposed on the non-conductive sheet member by the base cloth being fixed onto the non-conductive sheet member, and a coefficient of elasticity of the base cloth is lower than a coefficient of elasticity of the non-conductive sheet member.

* * * * *